US008116462B2

(12) United States Patent
Duxans Barrobes et al.

(10) Patent No.: US 8,116,462 B2
(45) Date of Patent: Feb. 14, 2012

(54) METHOD AND SYSTEM OF REAL-TIME IDENTIFICATION OF AN AUDIOVISUAL ADVERTISEMENT IN A DATA STREAM

(75) Inventors: Helenca Duxans Barrobes, Madrid (ES); David Conejer Olesti, Madrid (ES); Xavier Anguera Miro, Madrid (ES); Urtzi Urdapilleta Roy, Madrid (ES)

(73) Assignee: Telefonica, S.A., Madrid (ES)

( * ) Notice: Subject to any disclaimer, the term of this patent is extended or adjusted under 35 U.S.C. 154(b) by 345 days.

(21) Appl. No.: 12/610,588

(22) Filed: Nov. 2, 2009

(65) Prior Publication Data

US 2010/0111312 A1 May 6, 2010

Related U.S. Application Data

(60) Provisional application No. 61/110,853, filed on Nov. 3, 2008.

(51) Int. Cl.
*H04R 29/00* (2006.01)

(52) U.S. Cl. ..... 381/56

(58) Field of Classification Search ..... 381/56
See application file for complete search history.

(56) References Cited

U.S. PATENT DOCUMENTS

| | | | | |
|---|---|---|---|---|
| 2004/0125961 | A1* | 7/2004 | Alessio et al. | 381/56 |
| 2005/0027514 | A1* | 2/2005 | Zhang et al. | 704/205 |
| 2007/0177743 | A1* | 8/2007 | Mertens | 381/107 |

OTHER PUBLICATIONS

Covell, et al., in *Advertisement detection and replacement using acoustic and visual repetition*, in Proc. IEEE 8th Workshop on Multimedia Signal Processing, pp. 461-466, Oct. 2006.
Duan, et al., in *Segmentation, Categorization, and identification of commercials from TV Streams Using Multimodal Analysis*, in Proc. ACM Multimedia 2006, Santa Barbara, USA.
Duyguly, et al., in *Comparison and combination of two novel commercial detection methods*, in Proc. ICME, Taiwan, 2004.
A.G. Hauptmann and M. J. Vitbrock, *Story segmentation and detection of commercials in broadcast news video*, in Proceedings ADL'98, Santa Barbara, USA, 1998.
Hua, et al., in *Robust learning-based TV commercial detection*, in Proc ICME, 2005.
Lienhart, et al., *On the detection and recognition of television commercials*, in Proc of IEEE Conference on Multimedia Computing and Systems, pp. 209-519, Ottawa, Canada, 1997.
Sadlier, et al., *Automatic TV advertisement detection from mpeg bitstream*, Journal of the Pattern Recognition Society, 35(12):2-15, 2002.
J. Sánchez and X. Binefa, *Audicom; a video analysis system for auditing commercial broadcasts*, in Proc. of ICMCS'99, Firenze, Italy, 1999.

* cited by examiner

*Primary Examiner* — Davetta W Goins
*Assistant Examiner* — Amir Etesam
(74) *Attorney, Agent, or Firm* — Knobbe Martens Olson & Bear, LLP

(57) ABSTRACT

Method and system of identification of at least one audiovisual advertisement in a data stream, such as a digital television broadcasting, by detecting energy drops in an audio stream of the data stream and comparing a segment of the audio stream starting at the energy drop with an audio segment of the advertisement. The comparison step requires only a few seconds of data to perform the detection. Therefore, the identification of the advertisement is provided before the end of the advertisement in the data stream.

9 Claims, 1 Drawing Sheet

METHOD AND SYSTEM OF REAL-TIME IDENTIFICATION OF AN AUDIOVISUAL ADVERTISEMENT IN A DATA STREAM

CROSS-REFERENCE TO RELATED APPLICATIONS

This application claims priority under 35 U.S.C. §119 to U.S. Provisional Application No. 61/110,853, which was filed on Nov. 3, 2008, the disclosure of which is hereby incorporated by reference in its entirety.

FIELD OF THE INVENTION

The present invention relates to multimedia processing and, in particular, to extracting information from broadcasted multimedia documents, for example TV, radio or Internet broadcasts.

STATE OF THE ART

Currently, most of the methods of advertisement detection and identification for monitoring purposes or augmented publicity purposes are performed by human professionals in a way that becomes tedious and time consuming.

In order to detect commercials on TV some efforts have been already made using either video or audio or audio plus video. When using video alone, a combination of rules identifying the dynamics of commercial insertion by the broadcasting companies and image features are used, for example searching for black frames or shot-cuts rate average. Examples of such proposals can be found in A. G. Hauptmann, M. J. Witbrock, *Story segmentation and detection of commercials in broadcast news video*, in *Proceedings ADL*'98, Santa Barbara, USA, 1998; in R. Lienhart, C. Kuhmnch, W. Effelsberg, *On the detection and recognition of television commercials*, in *Proc of IEEE Conference on Multimedia Computing and Systems*, pages 509-516, Otawa, Canada, 1997; and in J. Sánchez, X. Binefa, Audicom: a video analysis system for auditing commercial broadcasts, in *Proc. Of ICMCS*'99, Firenze, Italy, 1999. However, these systems are usually computationally expensive and cannot achieve the performance of systems using audio features.

Other authors have proposed combined audio-visual methods. P. Duygulu et al., in *Comparison and combination of two novel commercial detection methods*, in *Proc. ICME, Taiwan,* 2004, exploit the repetition of commercials over time using video and refine the results using audio features, while M. Covell et al., in *Advertisement detection and replacement using acoustic and visual repetition*, in *Proc. IEEE 8th Workshop on Multimedia Signal Processing*, pp. 461-466, October 2006, analyze both audio and video features for repetitions. However, such approaches fail whenever non-commercial segments are repeated (for example in news programs).

In Automatic tv advertisement detection from mpeg bitstream, *Journal of the Pattern Recognition Society,* 35(12):2-15, 2002, D. A. Sadlier et al. use black video frames and audio energy together with a rule-based decision algorithm, with several fine-tuned thresholds. X.-S. Hua et al., in *Robust learning-based tv commercial detection*, in *Proc. ICME,* 2005, combine a set of visual and acoustic-based features with an SVM (Support Vector Machine) classifier for every detected video shot. In doing so they consider that all commercials contain common audio-video features that difference them from regular content, which is not necessarily true in all cases.

Finally, Ling-Yu Duan et al., in *Segmentation, Categorization, and identification of commercials from TV streams Using Multimodal Analysis*, in *Proc. ACM Multimedia* 2006, Santa Barbara, USA, discusses about detection and multimodal classification of commercials, for which the use of intervals of silence between commercials is suggested. Advertisements are classified in general categories, without keeping track of the repetitions of each advert, and with a high computational cost.

Therefore, there is a need to optimize and automatize the process of detection and identification of advertisements in order to achieve sufficient performance. A low computational cost is required in order to allow real-time systems to detect and identify a target advertisement (or a plurality of target advertisements) few seconds after their beginning in scenarios such as on-line video and audio streaming. This would ease its processing and allow for many applications, especially in the broadcasting industry, such as augmented publicity by inserting personalized items in the audiovisual signal when a target advertisement is detected and only while the target advertisement is on air. Therefore, the identification of advertisements must be performed not only in real-time, but before the broadcasting of the advertisement finishes.

SUMMARY OF THE INVENTION

The present invention is intended to address the above mentioned need.

In a first aspect of the present invention there is provided a method of identification of audiovisual advertisements which allows to detect and identify advertisements from a predefined set on a data stream (such as an audio stream, or a video stream, based on its associated audio stream), only few seconds after an advertisement starts to be broadcasted or played.

In order to achieve real-time performance and low computational load, points of the data stream where advertisements may start are detected as having an energy drop in the audio stream. Advertisements are typically separated from each other and from the rest of the content of the data stream by short spaces of silence or low level audio energy, thus allowing to detect its start point in an efficient manner.

Preferably, in order to check the audio stream to locate the energy drops, a given period of time is divided into shorter time windows. The mean energy of each of the windows is computed, as well, as the mean energy of the combination of all the windows. If the ratio resulting from dividing the minimum mean energy among windows by the mean energy of their combination is lower than a given threshold, it means that a window of the audio stream presents a much lower energy than the rest of the nearby windows, and is thus considered as being an energy drop.

Energy drops are then considered as candidates for being start points of one of the advertisements of the aforementioned set. To check if a given advertisement is really present, the audio stream (starting at the instant of the energy drop) is compared to audio segments which contain the beginning of the advertisement. This comparison is performed by means of a similarity measurement using segments of a predefined length, i.e. not the full advertisement is compared in order to perform the task more efficiently and also to get the identification decision while the advertisement is being broadcasted or played. If the similarity measurement is over a predefined threshold, the method considers that the advertisement is identified in the audio stream.

Preferably, the similarity measurement is a standard cross-correlation applied to fourier coefficients, being the coefficients computed after multiplying the involved signals (the segment of the audio stream and the audio segment of the target advertisement) by a window that reduces influence of the beginning and ending of the signals (such as a Hamming window), which are more likely to differ. Only the cross-correlation coefficients related to shifts of half of the period of time used for the energy drop detection are taken into account. This choice for similarity computation provides an accurate identification, while being efficient and not resource-consuming.

In a further aspect of the present invention there is provided a device comprising means for carrying out the above-mentioned method.

Finally, the invention also refers to a computer program comprising computer program code means adapted to perform the steps of the above-mentioned method when said program is run on a computer, a digital signal processor, a field-programmable gate array, an application-specific integrated circuit, a micro-processor, a micro-controller, or any other form of programmable hardware.

The advantages of the proposed invention will become apparent n the description that follows.

BRIEF DESCRIPTION OF THE DRAWINGS

To complete the description and in order to provide for a better understanding of the invention, a set of drawings is provided. Said drawings form an integral part of the description and illustrate a preferred embodiment of the invention, which should not be interpreted as restricting the scope of the invention, but rather as an example of how the invention can be embodied. The drawings comprise the following figures.

DESCRIPTION OF PREFERRED EMBODIMENTS OF THE INVENTION

Figure 1:
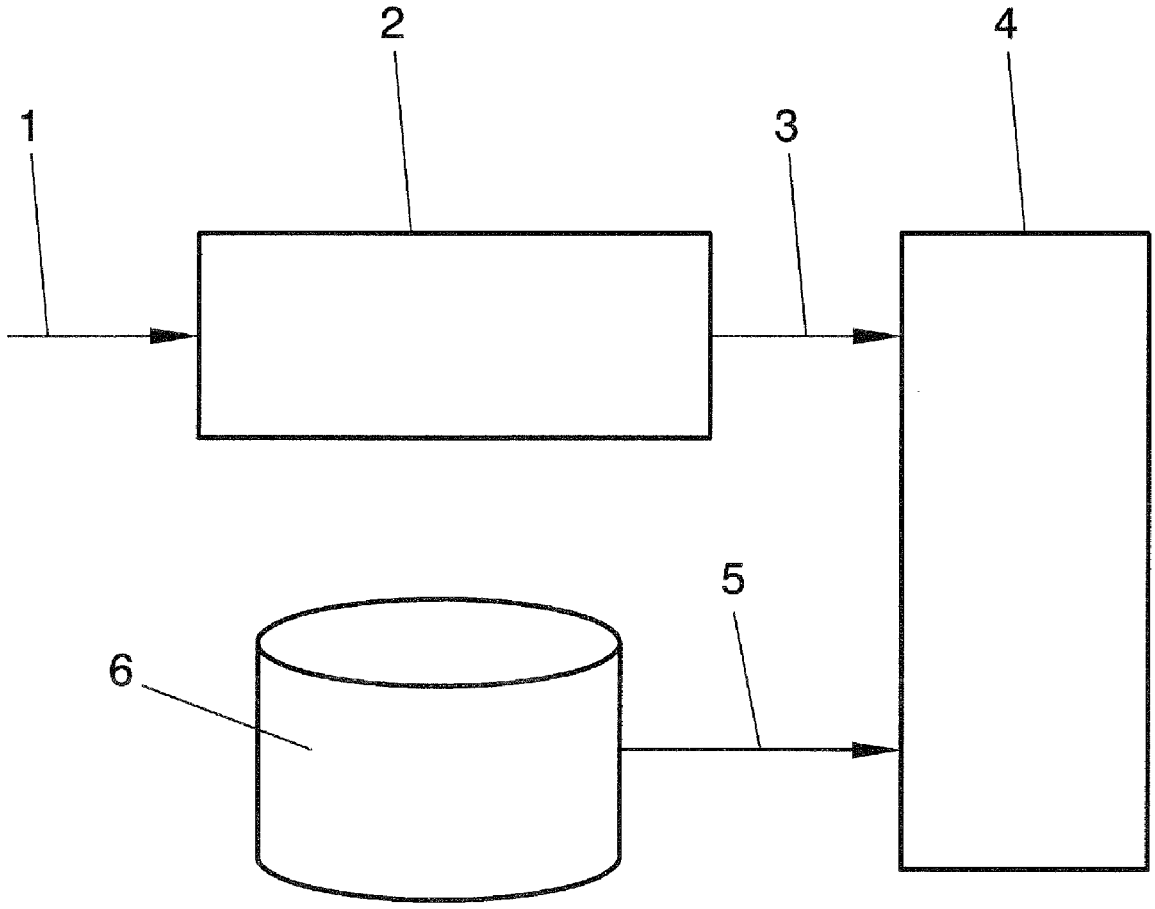
FIG. 1 shows an schematic representation of the modules of the system, and the information exchanged among them, according to a practical embodiment of the same.

In this text, the term "comprises" and its derivations (such as "comprising", etc.) should not be understood in an excluding sense, that is, these terms should not be interpreted as excluding the possibility that what is described and defined may include further elements, steps, etc.

FIG. 1 shows a preferred embodiment of the system of the invention, in which detecting means 2 detect segments 3 of a data stream 1 which comprise advertisements by checking for energy drops, being these segments 3 then identified by comparison means 4 by looking for equivalences in segments of audio 5 of advertisements stored in a database 6.

Advertisement breaks are usually isolated from actual programme material by a decrease in the audio signal occurring before and after each individual advertisement. Usually these silences last from 10 to 30 milliseconds and are digital nulls when advertising agencies and broadcasters use digital equipment. However, it is possible, and maybe quite probable, that these energy drops also occur during the valuable material of the programme itself.

Thus, the first step of the method is detecting energy drops which may isolate advertisements in order to perform the identification of advertisements only in segments where it is probable that an advertisement occurs. The audio stream is inspected every second looking for a drop in the mean energy. To determine the drop, each second (activation gap) is divided into shorter non-overlapping windows and the ratio between every window mean energy and the mean energy of the complete second is calculated. Only when the minimum ratio is lower than an activation threshold the system performs the identification.

Once the identification system is activated, the N seconds of the audio stream following that point are compared with the first N seconds of the target advertisements, which have been already stored in the system database. If the ratio of similarity is above a predefined threshold, the identification is considered positive (the advertisement appears in the audio stream, and thus, in the data stream). Notice that similarity can also be computed in terms of a distance, in which case, the identification is considered positive when the distance between the audio stream and the target advertisement is below a threshold. In the preferred embodiment, the similarity measure corresponds to the maximum of the spectral cross-correlation normalized by the signal powers. Both signals to be compared are first multiplied by a Hamming window in order to decrease the influence of the initial and ending regions. Only those cross-correlation coefficients corresponding to shifts of half second (half of the activation gap) between the audio stream and the audio of the target advertisements are considered when selecting the maximum of the spectral cross-correlation normalized by the signal powers.

A possible approach to determine the threshold to decide when the audio stream corresponds to a target advertisement is to collect all the distance values obtained when the identification system is fed with a development database and the target advertisements correspond to the repeated ads present in the recordings. The selected threshold (Th) is then computed as follows:

$$Th = \min_e - 0.25 * (\min_e - \mathrm{Max}_ne)$$

where min_e is the minimum similarity between equal segments and Max_ne is the maximum similarity value for non-equal segments found in the development database. This bias to min_e is due to a design criterion to prefer not to identify an advertisement than to miss-identified an audio segment.

According to experimental results, a 100% correct identification rate is achieved by using lengths over two seconds when comparing the audio stream and the advertisements (considering in such experiments only lengths of an integer number of seconds).

The invention is obviously not limited to the specific embodiments described herein, but also encompasses any variations that may be considered by any person skilled in the art (for example, as regards the choice of components, configuration, etc.), within the general scope of the invention as defined in the appended claims,

What is claimed is:

1. A method of real-time identification of at least one audiovisual advertisement in a data stream which comprises at least one audio stream with an energy, wherein said method comprises: periodically checking if there is an energy drop in the energy of the at least one audio stream; if an energy drop is detected in an instant, computing a measurement of similarity between a segment of the audio stream of a predefined length starting at the instant in which the energy drop is detected and a segment of audio of the predefined length corresponding to the beginning of the at least one audiovisual advertisement; if the measurement of similarity is above a predefined threshold, identifying the instant in which the energy drop is detected as a start point of the at least one advertisement in the data stream; and wherein the step of periodically checking if there is an energy drop, further comprises: measuring a mean energy of each of a plurality of windows of the audio stream; measuring a ratio by dividing the minimum mean energy of a window by the average mean energy of all the windows; if the ratio is lower than an activation threshold, detecting the window with the minimum mean energy as an energy drop.

2. The method of claim 1 wherein the measurement of similarity is a Maximum of a normalized standard cross-correlation between Fourier coefficients, only considering the coefficients corresponding to shifts of half of the predefined length used for the periodically check between the segment of the audio stream and the segment of audio corresponding to the beginning of the at least one audiovisual advertisement.

3. The method of claim 1 wherein, prior to computing the measurement of similarity, both the segment of the audio stream and the segment of audio corresponding to the beginning of the at least one audiovisual advertisement are multiplied by a window which reduces influence of initial and ending regions of a signal.

4. A system of real-time identification of at least one audiovisual advertisement in a data stream, wherein the system comprises means to perform the method according to claim 1.

5. A computer program comprising computer program code means adapted to perform the steps of the method according to claim 1 when said program is run on a programmable electronic device selected from a group of: a general purpose processor, a digital signal processor, a field-programmable gate array, an application-specific integrated circuit, micro-processor and a micro-controller.

6. A method of real-time identification of at least one audiovisual advertisement in a data stream which comprises at least one audio stream with an energy, wherein said method comprises; periodically checking if there is an energy drop in the energy of the at least one audio stream; if an energy drop is detected in an instant, computing a measurement of similarity between a segment of the audio stream of a predefined length starting at the instant in which the energy drop is detected and a segment of audio of the predefined length corresponding to the beginning of the at least one audiovisual advertisement; if the measurement of similarity is above a predefined threshold, identifying the instant in which the energy drop is detected as a start point of the at least one advertisement in the data stream; wherein the measurement of similarity is a maximum of a normalized Standard cross-correlation between Fourier coefficients, only considering the coefficients corresponding to shifts of half of the predefined length used for the periodically check between the segment of the audio stream and the segment of audio corresponding to the beginning of the at least one audiovisual advertisement; and wherein, prior to computing the measurement of similarity, both the segment of the audio stream and the segment of audio corresponding to the beginning of the at least one audiovisual advertisement are multiplied by a window which reduces influence of initial and ending regions of a signal.

7. The method of claim 6 wherein the step of periodically checking if there is an energy drop, further comprises: measuring a mean energy of each of a plurality of windows of the audio stream; measuring a ratio by dividing the minimum mean energy of a window by the average mean energy of all the windows; if the ratio is lower than an activation threshold, detecting the window with the minimum mean energy as an energy drop.

8. A system of real-time identification of at least one audiovisual advertisement in a data stream, wherein the system comprises means to perform the method according to claim 6.

9. A computer program comprising computer program code means adapted to perform the steps of the method according to claim 6 when said program is run on a programmable electronic device selected from a group of: a general purpose processor, a digital signal processor, a field-programmable gate array, an application-specific integrated circuit, a micro-processor and a micro-controller.

* * * * *